United States Patent [19]

Nashiwa et al.

[11] 4,129,439

[45] Dec. 12, 1978

[54] PROCESS FOR REFINING MOLTEN STEEL USING FERROALLOY

[75] Inventors: Hajime Nashiwa, Sakai; Susumu Tsuzita; Tsutomu Nagahata, both of Wakayama, all of Japan

[73] Assignee: Sumitomo Metal Industries, Ltd., Osaka, Japan

[21] Appl. No.: 727,998

[22] Filed: Sep. 30, 1976

Related U.S. Application Data

[63] Continuation of Ser. No. 578,750, May 19, 1975, abandoned.

[30] Foreign Application Priority Data

May 24, 1974 [JP] Japan ..... 49-58946

[51] Int. Cl.[2] ..... C21C 7/00; C22C 28/00

[52] U.S. Cl. ..... 75/58; 75/53; 75/129; 75/134 M

[58] Field of Search ..... 75/53, 58, 129, 134 M

[56] References Cited

U.S. PATENT DOCUMENTS

| | | | |
|---|---|---|---|
| 2,847,296 | 8/1958 | Hilty | 75/129 |
| 3,218,157 | 11/1965 | Dobrowsky | 75/129 |
| 3,741,753 | 6/1973 | Walz | 75/129 |

*Primary Examiner*—P. D. Rosenberg

[57] ABSTRACT

Disclosed is a ferroalloy for refining molten steel, composed of, by weight, 5 to 40% Si, 40 to 80% Mn, 1 to 10% Al, and the remainder of Fe with inevitable amounts of impurities. The ferroalloy is suitable for use in deoxidizing molten steel and adjusting the composition thereof.

5 Claims, No Drawings

PROCESS FOR REFINING MOLTEN STEEL USING FERROALLOY

This is a continuation, of application Ser. No. 578,750, filed May 19, 1975.

BACKGROUND OF THE INVENTION

The present invention relates to metal-refining ferroalloy to be added to molten steels, particularly to killed steel, for the purpose of deoxidizing the steel and adjusting the composition thereof.

Aluminum has been widely used as deoxidizer and grain-size controller in the manufacture of steels, particularly killed steel, by the hot-metal process. In the conventional method, aluminum is added to the molten steel by throwing small solid masses of aluminum into the molten steel bath. Such addition suffers, however, from the disadvantage that, because of the lower specific gravity of aluminum than molten steel and the high reactivity of aluminum with molten steel, the masses of aluminum cannot penetrate into the molten steel with sufficient depth so that the yield of aluminum addition is not only poor but is wide and unpredictable variation. The term "yield of aluminum addition" as used herein means a ratio of the amount of aluminum contained in a product to that added to molten steel.

A method has been proposed for improving and stabilizing the yield of aluminum addition, in which aluminum is added to molten steel by shooting aluminum shaped in the form of cannon balls into the bath at a high speed. It is difficult, however, by this method to accomplish rapid addition of a large amount of aluminum because of the limited capacity of the shooter.

BRIEF SUMMARY OF THE INVENTION

It is therefore an object of the present invention to provide a ferroalloy suitable for use in the steel-refining. By the use of the ferroalloy of the present invention, a higher yield of aluminum addition to molten steel can be obtained.

The ferroalloy of the present invention is similar to the Si-Mn ferroalloy which is widely used in refining killed steel but additionally contains 1 to 10% aluminum and is best used in the form of small solid masses. When the ferroalloy of the present invention is added to molten steel by manually throwing or any other suitable method, the ferroalloy penetrates into the molten steel in sufficient depth and as a consequence a good yield of aluminum addition is obtained. For example, the yield of aluminum addition may be about 30% higher than that obtained when the small masses of unalloyed aluminum are added.

The ferroalloy of the present invention may be added to molten steel in combination with cannon balls of unalloyed aluminum shot by the conventional high-speed shooting method, so as to further increase the yield of aluminum addition.

DETAILED DESCRIPTION OF THE INVENTION

The ferroalloy of the present invention is composed of, by weight, 5 to 40% silicon, 40 to 80% manganese, 1 to 10% aluminum, and the remainder of iron with inevitable amounts of impurities.

The composition of the ferroalloy of the present invention is determined by the composition of molten steel at the end point of oxygen blowing in the converter and the required composition of the steel product in view of the amount of the ferroalloy to be added to the molten steel (which generally ranges about 1 to 20 kg per ton of the steel). This can be more clearly understood from the following fact: When the ferroalloy of the present invention is added to molten steel in an amount of 20 kg per ton of the steel, in the case of adding it to a high molybdenum steel, it follows that 2 kg of net aluminum is added to 1 ton of the steel if the ferroalloy contains 10% aluminum(the upper limit according to this invention). As the yield of aluminum addition varies from about 20% to 50% depending upon the carbon content of the steel at the end point of the converter blowing, the result is that the product steel contains 0.040 to 0.100% of soluble aluminum therein. If the content of soluble aluminum in the product steel exceeds these values, the product steel tends to unacceptably brittle. On the other hand, when the aluminum content of the ferroalloy is less than 1.0%, no particular effect can be achieved in the final product by the addition of aluminum.

In a typical embodiment of the present invention, there is provided a ferroalloy composed of, by weight, Si 13–16%
Mn 55–63%
Al 4–6% the remainder being Fe and inevitable amounts of impurities (the ferroalloy of this composition is hereinafter referred to as "ferroalloy A").

Steel used as linepipes for oil or gas should have a grade superior to X-52 of the API standards. The abbreviation "API" used herein signifies "American Petroleum Institute". Such a steel generally comprises 0.04–0.15% C, 0.15–0.30 Si, 1.00–1.50% Mn, and 0.010–0.050% soluble Al and the remainder of iron.

High strength steel plate of 50 kg/mm$^2$ class is generally composed of 0.12–0.20% C, 0.20–0.50% Si, 1.20–1.60% Mn, 0.02–0.050% soluble Al and the remainder of iron. In ordinary refining process of these steel materials in LD convertor, the steel composition is adjusted to contain 0.03–0.12% C, 0.10–0.25% Mn and the balance of iron at the end point of oxygen blowing. By simple addition of ferroalloy A to molten steel having the above end point composition in an amount of 17–22 kg/ton of steel, it is possible to deoxidize the steel and concurrently adjust the steel composition within the required range for the final products.

As another example of the steels to which the ferroalloy A is applicable, there can be mentioned the steel, N-80, P-110 of the API standards, suitable for use as casing pipe material and having the general composition: 0.20–0.38% C, 0.20–0.35% Si, 1.20–1.80% Mn, and 0.010–0.050% Sol. Al and the remainder of iron. In refining of this teel, molten steel at the end point of the converter is adjusted to contain 0.12 to 0.25% of C and 0.20 to 0.32% of Mn. When the ferroalloy A is added to this molten steel in an amount of 17–22 kg per ton of the steel, manganese and soluble aluminum content in the molten steel can be adjusted within the required range as defined in the standards, by simple addition of the ferroalloy A.

As a further example of the steels to which the ferroalloy A is applicable, there is the steel, K-55 of the API Standards, suitable for use as casing pipe material having the general composition: 0.40–0.60% C, 0.15–0.35% Si, 0.70–1.00% Mn, and 0.010–0.050% sol Al and the remainder of iron. In refining of this teel, the molten steel at the end point of the converter is adjusted to contain 0.30 to 0.50% of C and 0.25 to 0.32% of Mn. When the ferroalloy A is added to this molten steel in an amount of 7–10 kg per ton of the steel, manganese and soluble aluminum contents in the molten steel can be adjusted within the required range, as defined in the standards, by simple addition of the ferroalloy A.

In another typical embodiment of the present invention, there is provided a ferroalloy composed of, by weight, Si 27–32%
Mn 48–55%
Al 8–10% the remainder being Fe and inevitable amounts of impurities (the ferroalloy of this composition is referred to as ferroalloy B).

Ferroalloy B is suitable for use in refining the steel for plate of 40 kg/mm$^2$ class composed of 0.10–0.18% C, 0.15–0.35% Si, 0.60–1.10% Mn, and 0.010–0.050% sol. Al and the remainder of Fe, and also the piping steels of the Class 5LA or 5LB of the API Standards composed of 0.10–0.24% C, 0.15–0.35% Si, 0.50–0.80% Mn and 0.010–0.050% sol. Al and the remainder of Fe. These steels contain, in their molten states at the end point of oxygen blowing in the converter, 0.07 to 0.17% C and 0.12 to 0.22% Mn. By adding the ferroalloy B to the molten steel in an amount of 7 to 12 kg per ton of the steel, the silicon, manganese and sol. aluminum contents can be controlled within the range as defined in the standards.

The ferroalloy of the present invention may be added to molten steel when it is transferred from the converter to the ladle or during DH vacuum degassing or argon-bubbling process.

The ferroalloy of the present invention is preferably shaped into small solid masses or particles, 5 to 80 mm and preferably 20 to 80 mm in diameter, and is added to molten steel through the chute from the hopper.

The present invention will be understood more clearly with reference to the following examples. It should be noted however that these examples are intended to illustrate the invention and are not to be construed to limit the scope thereof.

EXAMPLE 1

Ferroalloy of the present invention, composed of 15% Si, 62% Mn, 7% Al and the remainder of Fe and inevitable amounts of impurities, was added to molten middle-carbon killed steel transferred to the ladle from a converter of the 160-ton capacity. The addition was carried out in an amount of 20 kg of the ferroalloy per ton of the steel (1.4 kg of net aluminum per ton of steel).

The result was that the yield of aluminum addition was 25% and the soluble aluminum content of the product steel was 0.035%.

In the same manner, bar-shaped masses of unalloyed aluminum were added to molten killed steel according to the conventional method in an amount of 1.6 kg of the bar-shaped masses per ton of steel, with the result that the yield of aluminum addition was 17% and the soluble aluminum content of the product steel was 0.027%.

EXAMPLE 2

Ferroalloy of the present invention, composed of 26% Si, 50% Mn, 10% Al and the remainder of Fe and inevitable amounts of impurities, was added to molten middle-carbon killed steel transferred to the ladle from a converter of the 160-ton capacity. The addition was carried out in an amount of 13 kg of the ferroalloy per ton of the steel (1.3 kg of net aluminum per ton of steel). The yield of aluminum addition was 28% and the soluble aluminum content of the product steel was 0.036%.

When bar-shaped masses of unalloyed aluminum were added to molten killed steel according to the conventional method in an amount of 1.5 kg of the bar-shaped masses per ton of steel, the result was that the yield of aluminum addition was 20% and the soluble aluminum content of the product steel was 0.030%.

EXAMPLE 3

Ferroalloy of the present invention, composed of 15% Si, 70% Mn, 3% Al and the remainder of Fe and inevitable amounts of impurities, was added to molten middle-carbon killed steel transferred to the ladle from a converter of the 160-ton capacity. The addition was carried out in an amount of 21 kg of the ferroalloy per ton of the steel (0.63 kg of net aluminum per ton of steel). The result was that the yield of aluminum addition was 50% and the soluble aluminum content of the product steel was 0.032%.

In the same manner, bar-shaped masses of unalloyed aluminum were added to molten killed steel according to the conventional method in an amount of 0.6 kg of the bar-shaped masses per ton of steel, with the result that the yield of aluminum addition was 29% and the soluble aluminum content of the product steel was 0.018%.

The results are summarized in the following table.

| Sample | | Amount added (Kg/T) | Net Al added (Kg/T) | Composition (%) C | Si | Mn | Sol.Al | Yield of Al addition (%) | Composition at Converter End Point C | Mn |
|---|---|---|---|---|---|---|---|---|---|---|
| Present Invention | A | 20 | 1.40 | 0.16 | 0.40 | 1.38 | 0.035 | 25 | 0.06 | 0.14 |
| | B | 13 | 1.30 | 0.17 | 0.32 | 0.98 | 0.036 | 28 | 0.07 | 0.15 |
| | C | 21 | 0.63 | 0.36 | 0.30 | 1.75 | 0.032 | 50 | 0.29 | 0.29 |
| Conventional Method | D | 1.6 | 1.60 | 0.16 | 0.39 | 1.36 | 0.027 | 17 | 0.05 | 0.12 |
| | E | 1.5 | 1.50 | 0.16 | 0.24 | 0.95 | 0.030 | 20 | 0.09 | 0.16 |
| | F | 0.6 | 0.60 | 0.36 | 0.30 | 1.73 | 0.018 | 29 | 0.25 | 0.30 |

It is clearly seen from the table that, when aluminum was added to molten steel in the form of the ferroalloy of the present invention, the yield of aluminum addition was greatly improved in comparison with the conventional method of adding masses of unalloyed aluminum. Example 2 shows that, when the ferroalloy of the present invention (Sample B) was added at the ratio of 1.30 kg (on the basis of pure aluminum) per ton of the steel, the yield obtained was 28% in contrast to 20% obtained by the conventional method (Sample E) at the ratio of 1.5 kg/ton. Further, Example 3 shows that, by adding the ferroalloy of the present invention (Sample C) at the ratio of 0.63 kg (on basis of aluminum) per ton of the steel, the yield of aluminum addition was 50% which is remarkably higher than the 29% by the addition of masses of unalloyed aluminum (Sample F) at the ratio of 0.60 kg per ton of the steel according to the conventional method.

In addition to improving and stabilizing the yield of aluminum addition, the present invention provides a further advantage in that it reduces the number of steps required for adjusting the composition of steel being manufactured since the simultaneous addition of silicon, manganese and aluminum can be achieved by adding the ferroalloy of the present invention thus eliminating the need for separate addition of the Si-Mn ferroalloy and Al as is conventionally practised.

While the above embodiments have been described mainly in relation to the manufacture of steel by the converter process, the ferroalloy of the present invention is also applicable to any other processes for the manufacture of steel including the electric furnace process.

What is claimed is:

1. In a process for the manufacture of steel composed of 0.12 to 0.20% C, 0.20 to 0.50% Si, 1.20 to 1.60% Mn, 0.02 to 0.05% Al and the remainder Fe, the improvement in which a ferroalloy consisting essentially of 13 to 16% Si, 55 to 63 Mn, 4 to 6% Al, and the remainder of Fe with inevitable amounts of impurities, is added to molten steel containing 0.03 to 0.12% C, 0.10 to 0.25% Mn and the balance of Fe, in an amount of 17 to 22 kg of said ferroalloy per ton of said molten steel so as to deoxidize increase the yield and homogeneity of aluminium addition and said steel and adjust the composition thereof.

2. In a process for the manufacture of steel composed of 0.20 to 0.38% C, 0.20 to 0.35% Si, 1.20 to 1.80% Mn, 0.01 to 0.05% Al and the remainder of Fe, the improvement in which a ferroalloy consisting essentially of 13 to 16% Si, 55 to 63% Mn, 4 to 6% Al, and the remainder of Fe with inevitable amounts of impurities, is added to molten steel containing 0.12 to 0.25% C, 0.20 to 0.32% Mn and the balance of Fe in an amount of 17 to 22 kg of said ferroalloy per ton of said molten steel so as to increase the yield and homogeneity of aluminium addition and deoxidize said steel and adjust the composition thereof.

3. In a process for the manufacture of steel composed of 0.40 to 0.60% C, 0.15 to 0.35% Si, 0.70 to 1.00% Mn, 0.01 to 0.05% Al and the remainder of Fe, the improvement in which a ferroalloy consisting essentially of 13 to 16% Si, 55 to 63% Mn, 4 to 6% Al, and the remainder of Fe with inevitable amounts of impurities, is added to molten steel containing 0.30 to 0.50% C, 0.25 to 0.32% Mn and the balance of Fe in an amount of 7 to 10 kg of said ferroalloy per ton of said molten steel so as to deoxidize said steel and adjust the composition thereof.

4. In a process for the manufacture of steel composed of 0.10 to 0.18% C, 0.15 to 0.35% Si, 0.60 to 1.10% Mn, 0.01 to 0.05% Al and the remainder of Fe, the improvement in which a ferroalloy consisting essentially of 27 to 32% Si, 48 to 55% Mn, 8 to 10% Al, and the remainder of Fe, with inevitable amounts of impurities, is added to molten steel containing 0.07 to 0.17% C, 0.12 to 0.22% Mn and the balance of Fe, in an amount of 7 to 12 kg of said ferroalloy per ton of said molten steel so as to increase the yield and homogeneity of aluminium addition and deoxidize said steel and adjust the composition thereof.

5. In a process for the manufacture of steel composed of 0.10 to 0.24% C, 0.15 to 0.35% Si, 0.50 to 0.80% Mn, 0.01 to 0.05% Al, and the remainder of Fe, the improvement of which a ferroalloy consisting essentially of 27 to 32% Si, 48 to 55% Mn, 8 to 10% Al, and the remainder of Fe with inevitable amounts of impurities, is added to molten steel containing 0.07 to 0.17% C, 0.12 to 0.22% Mn and the balance of Fe, in an amount of 7 to 12 kg of said ferroalloy per ton of said molten steel so as to increase the yield and homogeneity of aluminium addition and deoxidize said steel and adjust the composition thereof.

* * * * *